US010895160B1

(12) United States Patent
Sinclair

(10) Patent No.: US 10,895,160 B1
(45) Date of Patent: Jan. 19, 2021

(54) STRESS RELIEF VIA UNBLENDED EDGE RADII IN BLADE ATTACHMENTS IN GAS TURBINES

(71) Applicant: Glenn B. Sinclair, Baton Rouge, LA (US)

(72) Inventor: Glenn B. Sinclair, Baton Rouge, LA (US)

( * ) Notice: Subject to any disclaimer, the term of this patent is extended or adjusted under 35 U.S.C. 154(b) by 100 days.

(21) Appl. No.: 15/947,171

(22) Filed: Apr. 6, 2018

Related U.S. Application Data

(60) Provisional application No. 62/482,947, filed on Apr. 7, 2017.

(51) Int. Cl.
*F01D 5/30* (2006.01)
*F01D 5/14* (2006.01)
*F01D 5/02* (2006.01)

(52) U.S. Cl.
CPC ..... *F01D 5/3007* (2013.01); *F01D 5/02* (2013.01); *F01D 5/147* (2013.01); *F05D 2250/71* (2013.01); *F05D 2260/30* (2013.01)

(58) Field of Classification Search
CPC ..... F01D 5/3007; F01D 5/02; F01D 5/141; F01D 5/147; F05D 2250/71; F05D 2260/30
See application file for complete search history.

(56) References Cited

U.S. PATENT DOCUMENTS 2,429,215 A * 10/1947 Boestad ..... F01D 5/3007 416/219 R
4,169,694 A 10/1979 Sanday
4,621,979 A 11/1986 Zipps et al.
4,692,976 A 9/1987 Andrews
4,824,328 A * 4/1989 Pisz ..... F01D 5/3007 416/219 R
5,067,876 A * 11/1991 Moreman, III ..... F01D 5/3007 416/219 R
5,110,262 A 5/1992 Evans
5,141,401 A 8/1992 Juenger et al.
(Continued)

FOREIGN PATENT DOCUMENTS

GB 1183835 A * 3/1970 ..... F01D 5/084
GB 1482308 8/1977
(Continued)

OTHER PUBLICATIONS

Shtayerman, "Contact Problems of the Theory of Elasticity", Kontaktnaya Zadacha Teorii Uprugostii, 1949, 1970 (English translation), Gostekhizdat Publishing, Moscow.
(Continued)

*Primary Examiner* — J. Todd Newton
*Assistant Examiner* — Christopher R Legendre
(74) *Attorney, Agent, or Firm* — The Webb Law Firm

(57) ABSTRACT

An improved gas turbine engine, a blade for a gas turbine for attachment to a rotor disk of the gas turbine engine and a method for manufacturing thereof. Specifically, the blade includes an airfoil attached to at least one base, wherein each of the bases is adapted to be received within a slot defined in the disk. At least one of the bases has a contacting surface for contacting a corresponding surface of the disk. Increased edge radii at the ends of the contacting surfaces are provided by not having contacting surfaces that blend in with the side surfaces.

19 Claims, 11 Drawing Sheets

(56) References Cited

U.S. PATENT DOCUMENTS

| | | | | |
|---|---|---|---|---|
| 5,160,242 | A | 11/1992 | Brown | |
| 5,554,005 | A * | 9/1996 | Nguyen | F01D 5/3007 416/219 R |
| 5,567,116 | A * | 10/1996 | Bourcier | F01D 5/3007 416/219 R |
| 5,593,282 | A * | 1/1997 | Krueger | F01D 5/225 416/219 R |
| 6,033,185 | A * | 3/2000 | Lammas | F01D 5/3038 416/193 A |
| 6,183,202 | B1 * | 2/2001 | Ganshaw | F01D 5/3007 416/219 R |
| 6,244,822 | B1 | 6/2001 | Sinclair et al. | |
| 6,302,651 | B1 | 10/2001 | Kildea et al. | |
| 6,652,237 | B2 * | 11/2003 | Yehle | F01D 5/3046 416/219 R |
| 7,056,094 | B2 * | 6/2006 | Udell | F01D 5/3015 416/219 R |
| 7,156,621 | B2 | 1/2007 | Stone | |
| 7,594,799 | B2 * | 9/2009 | Miller | F01D 5/147 416/219 R |
| 8,151,459 | B2 * | 4/2012 | Roberts | B23H 9/10 29/889.7 |
| 8,439,724 | B2 | 5/2013 | El-Wardany et al. | |
| 8,887,391 | B2 | 11/2014 | Barnat | |
| 9,488,059 | B2 | 11/2016 | Ventura et al. | |
| 9,539,655 | B2 | 1/2017 | Barnat | |
| 10,287,898 | B2 * | 5/2019 | Bluck | F01D 5/3007 |
| 2013/0084188 | A1 * | 4/2013 | Nagano | F01D 5/30 416/219 R |
| 2016/0312629 | A1 * | 10/2016 | Evans | F01D 5/02 |

FOREIGN PATENT DOCUMENTS

| | | |
|---|---|---|
| GB | 2243413 A | 10/1991 |
| GB | 2293212 A | 3/1996 |
| GB | 2345943 B | 7/2003 |
| WO | 8700778 A1 | 2/1987 |

OTHER PUBLICATIONS

Sinclair et al., "Contact Stresses in Dovetail Attachments: Finite Element Modeling", ASME Journal of Engineering for Gas Turbines and Power, Jan. 2002, pp. 182-189, vol. 124.

Sinclair et al., "Contact Stresses in Dovetail Attachments: Physical Modeling", ASME Journal of Engineering for Gas Turbines and Power, Apr. 2002, pp. 325-331, vol. 124.

Sinclair, "Edge-of-Contact Stresses in Blade Attachments: An Analytical Approach with Implications for Varying Operating Conditions", Proceedings of ASME Turbo Expo, 2015: Turbine Technical Conference and Exposition, Paper No. GT2015-42991, Jun. 15-19, 2015, pp. 1-11, Montreal, Canada.

Sinclair, Friction Effects on Edge-of-Contact Stresses for Sliding Contact Between a Flat Punch With Rounded Corners and a Half Space:, Journal of Applied Mechanics, Dec. 2017, pp. 121001-1-121001-8, vol. 84.

* cited by examiner

STRESS RELIEF VIA UNBLENDED EDGE RADII IN BLADE ATTACHMENTS IN GAS TURBINES

CROSS REFERENCE TO RELATED APPLICATIONS

This application claims the benefit of U.S. Provisional Patent Application No. 62/482,947 entitled "Stress Relief Via Unblended Edge Radii in Blade Attachments in Gas Turbine" filed Apr. 7, 2017, which is incorporated herein by reference.

BACKGROUND OF THE INVENTION

Field of the Invention

The present invention relates to gas turbine engine blades and, more particularly, to the arrangement of securing the gas turbine blades to a rotating disk.

Description of Related Art

In gas turbine engines, blades are attached to disks with dovetail or firtree attachments. A section through a prior art dovetail attachment of a base of a turbine blade 3 attached to a portion of a disk 5 is shown in FIG. 1. An airfoil (not shown) is positioned above the attachment. A section through a prior art firtree attachment is shown in FIG. 2. In the first type of attachment, a blade airfoil above the line at 7 is restrained from releasing radially by a single pair of surfaces 9 and 11 whereon it makes contact with the disk 5 at surfaces 15 and 13, respectively. As a result, dovetail attachments are sometimes termed single-tooth attachments. FIG. 2 shows a prior art firtree attachment of a base of a turbine blade 23 attached to a portion of a disk 25. The attachment includes multiple pairs of contacting surfaces 27 and 29 that contact multiple pairs of disk surfaces 31 and 33, respectively. As a result, firtree attachments are sometimes called multi-tooth attachments.

During operation, the stress fields induced by contact on surfaces 9, 11 and 13, 15 for dovetail attachments, and 27, 29 and 31, 33 for firtree attachments, can fluctuate in magnitude and lead to fatigue failures in blades or disks. The costs associated with these failures are of the order of millions of dollars per year. Consequently, reducing this type of failure is highly desirable both from a safety and from an economic point of view. Hence an object of the present invention is to provide blade attachments which offer improved resistance to this type of failure.

Focusing on dovetail attachments, FIG. 1 shows a central section through the base of the turbine blade 3 and the segment of the disk 5 that effects its attachment. As a result of high angular velocities ($\omega$) that can be involved, large radial forces F can be generated. In the attachment of FIG. 1, the force F is balanced by contact forces on two flats, $C_1C_{1'}$ and $C_2C_{2'}$. In order to keep the whole arrangement as compact as possible, the lengths of these flats are limited relative to the other dimensions of the blade. However, by making them as long as possible, the nominal normal compressive pressure, p, on the contacting surfaces can be kept as low as possible for a given F. A consequence of keeping p down in this manner is the use of small radii at the edges of contact, for example, at $C_1$ on the disk and $C_{1'}$ on the blade (labeled as r in the close-up). This is also true for the out-of-plane direction as shown in FIG. 3 for a central section perpendicular to the section in FIG. 1. Small radii r' present for this section occur at the edges of contact, that is near $C_3$ and $C_{3'}$. For all of these small radii, contact is still conforming and stresses nonsingular. However, the actual contact pressure, $\sigma_c$, can have high gradients near the edges of contact. These high gradients lead to high peak $\sigma_c$ values. When slipping occurs with friction present, these high $\sigma_c$ in turn lead to large hoop stresses which are tensile in the blade at $C_1$ and the disk at $C_{1'}$. These tensile stresses have high gradients. This means that small fluctuations in engine operating rpm can lead to relatively large fluctuations in edge-of-contact hoop stresses. These last lead to fatigue failure over time. Hence an object of the present invention is to lower the magnitudes of the edge-of-contact stresses in blade attachments and so reduce the likelihood of fatigue failure.

Because the tensile hoop stresses are caused by frictional shear stresses in the contact regions, one arrangement for reducing the hoop stresses is to lower the coefficient of friction for the contacting surfaces. To this end, one practice used in the gas turbine industry is to introduce a layer of intervening material between the contacting surfaces. The material is chosen so as to facilitate slip between the blade and the disk and thereby reduce friction. It is believed that problems of attachment failure persist in the industry today even with the introduction of such intervening layers.

U.S. Pat. No. 5,110,262, which is incorporated by reference, shows an arrangement of reducing stresses at the edges of contact. This arrangement consists of making one of the in-plane contact surfaces barreled (see FIG. 3 of U.S. Pat. No. 5,110,262). This barreling reduces the peak contact stress in this plane, thus attendant shear stresses and hoop stresses. However, the height of the barreling is sufficiently large that contact with elastic stresses extends over less than half of the length of the flats (e.g., FIG. 3 of U.S. Pat. No. 5,110,262, which shows an elastic contact extent which is less than one quarter of the flats). As a result, p is increased by this arrangement. This leads to plastic flow and a redistribution of the contact stress over a larger portion of the flats. This elasto-plastic stress distribution has higher contact stresses near the edges of contact than a purely elastic or Hertzian distribution. Moreover, there is no reduction of the peak stresses near the edges of contact in the out-of-plane direction. Thus, the reduction in peak stresses near all the edges of contact afforded by the means in U.S. Pat. No. 5,110,262 is limited.

U.S. Pat. No. 5,141,401, which is incorporated herein by reference, teaches reducing peak stresses near the edge of contact in blade attachments as a way of alleviating fatigue failure. The arrangement disclosed by U.S. Pat. No. 5,141,401 to effect this end is to undercut the disk near $C_1'$ in FIG. 1. This patent discloses a demonstration of reduced stress at this location as a result of such undercutting. However, if contact occurs at the break point where the undercut is initiated, stresses can be expected to be higher than without undercutting. Moreover, no arrangement is put forward for reducing peak stresses in the blade at the edge of contact near $C_1'$, nor are any arrangements put forward for reducing such stresses in the out-of-plane direction. Thus, the reduction in peak stresses near all the edges of contact afforded by the means of U.S. Pat. No. 5,141,401 is limited.

U.S. Pat. No. 6,244,822, which is incorporated herein by reference, teaches reducing peak stresses near the edge of contact in blade attachments as a way of alleviating fatigue failure. The arrangement disclosed by U.S. Pat. No. 6,244,822 to effect this end is to crown or barrel one of the contact surfaces in both the in-plane and out-of-plane directions to a precise height. This height is determined, from stress analysis, to be such that contact extends over most of the available contact region at maximum rpm, and stresses thus remain elastic, or largely so. If sufficiently accurately machined in both the in-plane and out-of-plane directions for the attachment of all blades, contact stresses near the edges of contact can be reduced by means of U.S. Pat. No. 6,244,822.

SUMMARY OF THE INVENTION

The present invention offers a straightforward means of lowering edge-of-contact stresses, and hence their fluctuations, simply by adopting larger edge radii that do not blend with the side surfaces. Hereby "blend" is meant having a surface that has a continuously varying tangential direction. Thus, when contact surfaces do not blend with side surfaces, sharp corners result. The increased edge radii can be adjusted to ensure that these sharp corners are outside of the contact area for the full range of rpm being used. With this approach, the extent of current contact flats can be maintained, and thus, the nominal contact pressure, p, can also be maintained. Consequently, the large edge radii then lowers the edge-of-contact stresses. Moreover, with the same or similar extents of contact flats, the approach can be sufficiently accurately manufactured with the same level of machining precision and effort as used for current blade attachments. Like reference numerals between the prior art and the present invention are used for like parts. The prior art arrangement shown in FIGS. 1-8 correspond to U.S. Patent No. 6,244,822, which is hereby incorporated by reference. The present invention is directed to the transition surfaces discussed herein having non-blended surfaces.

More specifically, the present invention enables one to manufacture a robust blade easier than that of the prior art. Specifically, the present invention is a blade 3 for a gas turbine for attachment to a rotor disk 5 that includes an airfoil above line at 7 in FIG. 1, a base 3' of blade 3 to which the airfoil is attached, wherein the base is adapted to be received within a slot S defined in the disk. The base has a contacting surface (9, 11) for contacting a corresponding surface of the disk (13, 15), wherein the contacting surface is comprised of a flat surface 11 and at least one transition surface (between points 51-61) wherein the transition surface is made up of a radius segment having a radius R and blended and merged to a flat surface at point 51 and at the other end intersecting with the side or edge 4 of the base 3 to form a discontinuous intersection at point 61 with the side or edge 4 of the base, The blade 3 and disk 5 have an in-plane cross section contained within an in-plane plane, as shown in FIGS. 1, 9, and 10, and an out-of-plane cross section, as shown in FIG. 3, contained within an out-of-plane plane, wherein the in-plane plane is transverse to the out-of-plane plane, and wherein the in-plane cross section is a face profile of the blade and disk, such as shown in FIG. 1. The present invention can also include a cross section of the transition surface as contained within the in-plane plane (see FIGS. 9 and 10) and includes a face profile of the transition surface, and the flat surface 11, 13 are contained within flat surface planes (which go into the page of FIGS. 1, 9, and 10) that is transverse to the in-plane plane and out-of-plane plane (shown in FIG. 3). The cross section of the transition surface can be contained within the out-of-plane plane and includes a profile of the transition surface, wherein the flat surface is contained within the plane that are transverse to the in-plane plane and the out-of-plane plane. The blade and/or disk can include transition profiles in both the in-plane plane and out-of-plane plane.

The present invention can have a radius R at least two times greater than that of a radius r blended and merged flat surface and side surface of the base or disk and wherein the radius r begin at the same point 51, 35 on the flat surface (see FIGS. 9 and 10). The blade and or disk discontinuity may include a fillet Δr that has a radius an order of magnitude smaller than the radius R (see FIG. 9). The blade and disk can have a plurality of contacting surfaces and can be a dovetail or a firtree design (see FIGS. 1 and 2).

The present invention is also a rotor disk for a turbine for receiving the base of a turbine blade. Specifically, the present invention is a rotor disk 5 to receive the base of a blade 3 having a contacting surface (13, 15) within a slot of the disk 5 to receive the base of the blade 3 for contacting a corresponding contact surface (9, 11) of the base of the blade, wherein the contacting surface is comprised of a flat surface 13 and at least one transition surface (between points 35-45) wherein the transition surface is made up of a radius segment having a radius R and blended and merged to a flat surface at point 35 and at the other end intersecting with the side or edge 2 of the disk 5 to form a discontinuous intersection at point 45 with the side or edge 2 of the disk 5.

The present invention can be used in a gas turbine engine utilizing the rotor disk and blade detailed above. Furthermore, the present invention is directed to a method to manufacture the blade and or disk as described herein.

DESCRIPTION OF THE INVENTION

As stated previously, an object of the present invention is to reduce the stresses occurring near the edges of contact in blade attachments and thereby improve the fatigue life in these components. Before describing the preferred embodiments chosen to effect this end, the physics of the type of failure involved needs to be explained further.

Figure 1:
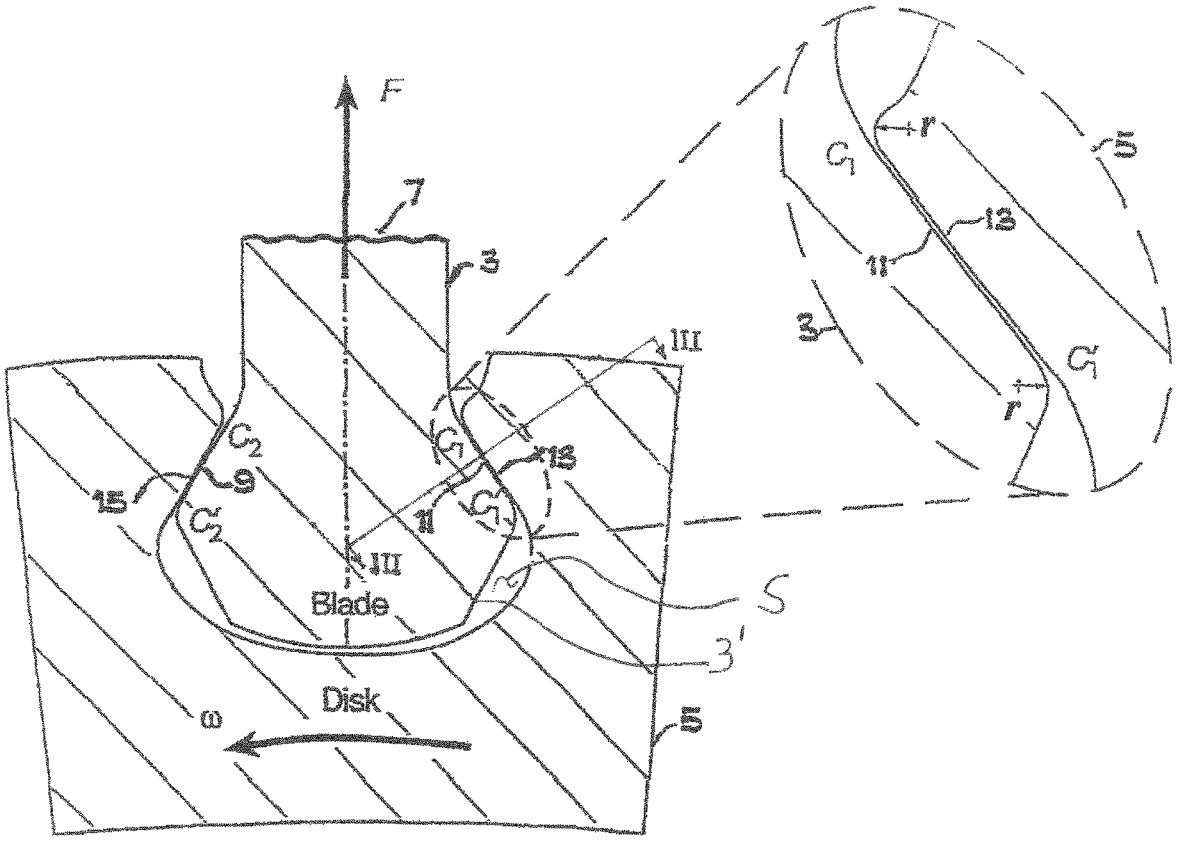
Fig.1 Prior Art
FIG. 1 is an elevational view of a prior art central in-plane section through a dovetail attachment of a base of a turbine blade and a portion of a disk of a gas turbine engine, with a close-up showing local radii of curvature near the edges of contact.

To this end, the physics of the dovetail attachment with the cross section shown in FIG. 1 is described next. Parallel physics apply to firtree attachments.

Figure 4:
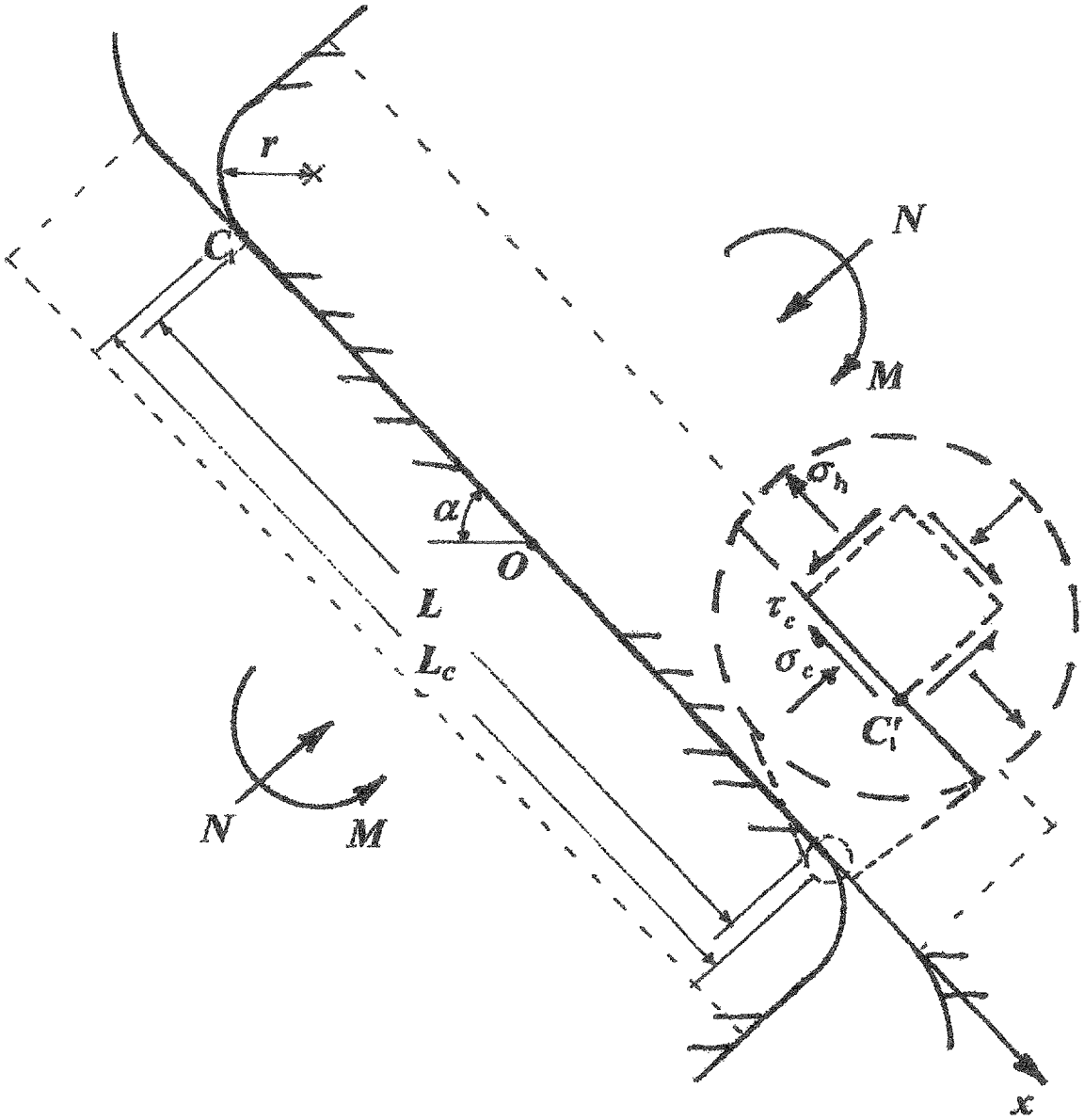
Fig. 4 Prior Art
FIG. 4 is an elevational view of a portion of the arrangement shown in FIG. 1 showing the stress resultants that act and a representation of the contact stresses.

The local contact configuration for the attachment in FIG. 1 is shown in greater detail in FIG. 4. Therein L is the length of the contact flat that is common to both the blade and the disk, and this flat is inclined at an angle $\alpha$ to the horizontal direction. At the ends of this flat there is a common edge radius r, on the disk at the upper end and on the blade at the lower. Under loading, actual contact expands a small amount onto these radii, shown schematically as extending to $C_1$ and $C_1$' in FIG. 4: the horizontal distance between $C_1$ and $C_1$' is denoted as the contact length $L_c$. To describe variations of stresses within $L_c$, a coordinate x aligned with the contact flat and having origin O at the center of the flat is introduced.

Contact between the blade and the rotor extending over the flat in FIG. 4 is produced by a normal pressure acting in concert with a bending stress. For the first of these, the associated nominal pressure on the contact flat, p, is given by $$p=N/L, N=F/2(\cos\alpha+f\sin\alpha), \quad \text{(Equation 1)}$$

where N is the resultant normal force (/unit out-of-plane extent) on a contact flat, and $f$ is the coefficient of friction between the blade and the rotor. Equation (1) is for slipping between the blade and the rotor. This has to occur for configurations like that of FIG. 1 during loading up because the outward radial displacements of the disk on either side of the blade are at a slight angle to one another, and consequently open up the gap in the disk within which the blade base resides. For the second of these, the associated nominal stress, $\sigma_m$, is $$\sigma_m=2\sigma x/L, \sigma=6M/L^2, \quad \text{(Equation 2)}$$

where $\sigma$ is the maximum nominal bending stress, and M is the resultant moment acting (/unit out-of-plane extent), and is taken to be positive when adding to N at x=L/2.

For the dovetail attachment of FIG. 1, F follows from the geometry and density of the blade, as well as the rotational speed at which the fan operates. For M, on the other hand, analysis is required because this moment is statically indeterminate. Since M is a stress resultant rather than a stress, this analysis can be fairly readily performed with 2D or even 3D finite elements.

By adapting the solution given in Shtaerman, *Contact Problems of the Theory of Elasticity*, Gostekhizdat Publishing, Moscow, 1949, the contact pressure distribution, $\sigma_c=\sigma_c(x)$, can be shown to be $$\sigma_c = \frac{EL_c}{8_\pi(1-\nu^2)r}\left[2\Phi\sin\phi + \ln\left(\left|\frac{\sin(\Phi+\phi)}{\sin(\Phi-\phi)}\right|^{\cos\phi}\left|\frac{\sin(\Phi-\phi)}{\sin(\Phi+\phi)}\right|^{\cos\Phi}\right)\right], \quad \text{(Equation 3)}$$

wherein $$\Phi = \cos^{-1}(L/L_c),\ \phi = \cos^{-1}(2x/L_c), \quad \text{(Equation 4)}$$

for $|x|\leq L_c/2$, and E is Young's modulus, v is Poisson's ratio. To quantify $\sigma_c$ using Equation 3, the contact length $L_c$ needs to be determined. This can be effected by solving $$\Phi\sec^2\Phi-\tan\Phi=16pr(1-\nu^2)/EL \quad \text{(Equation 5)}$$

for $\Phi$, hence $L_c$. The maximum peak values of the contact pressure of Equation 3 occur just inside the edge of contact, just outside of the contact flat. That is $L/2<|x_{max}|<L_c/2$ where $x_{max}$ is the location of $\sigma_c^{max}$. These locations can be determined by solving $$2\Phi\cot\hat{\phi} = \ln\left(\frac{\sin(\Phi+\hat{\phi})}{\sin(\Phi-\hat{\phi})}\right) \quad \text{(Equation 6)}$$

for $\hat{\phi}$, hence $x_{max}$ because $\cos\hat{\phi}=2x_{max}/L_c$. The corresponding maximum contact pressure is then given by $$\sigma_c^{max} = \frac{EL}{8\pi(1-\nu^2)r}\left[2\Phi\sec\Phi\csc\hat{\phi} + \ln\left(\frac{\sin\Phi-\sin\hat{\phi}}{\sin\Phi+\sin\hat{\phi}}\right)\right]. \quad \text{(Equation 7)}$$

Figure 5:
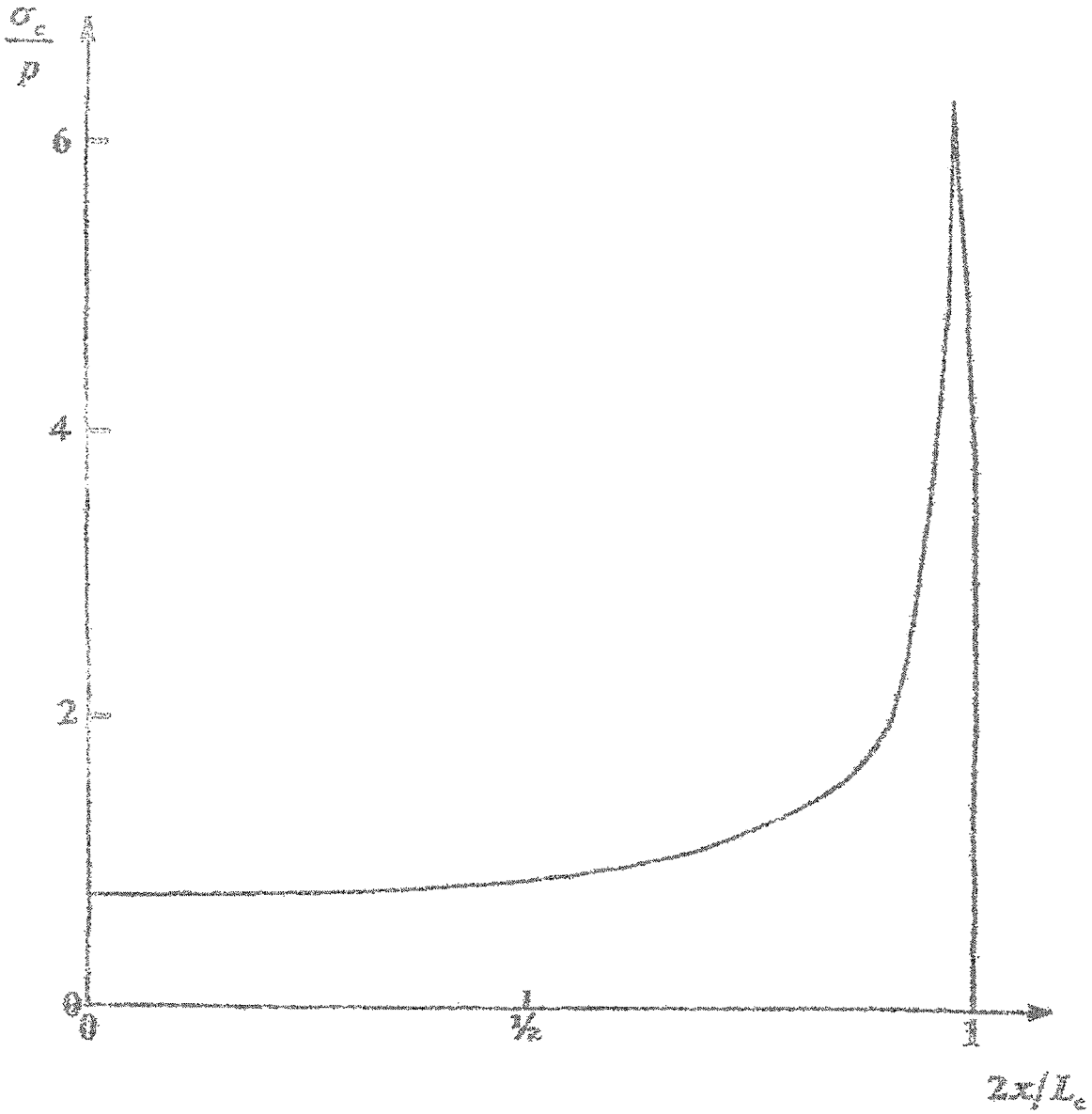
Fig. 5 Prior Art
FIG. 5 is a graphic representation of the contact pressure.

A demonstration of the application of these equations for $\sigma_c$ for a dovetail attachment follows from taking the specifications given in Sinclair et al., *ASME Journal of Engineering for Gas Turbines and Power*, Vol. 124, pp. 182-189, 2002, which has r/L=7/52, and at maximum rpm has $p(1-v^2)/E=1.805\times10^{-3}$. Then solving Equations 5 and 6 using the secant method gives $\Phi$=10.2252 deg, $\hat{\phi}$=8.5233 deg. The first of these angles corresponds to contact extending onto the edge radii by an amount that is but 0.8% of L or 6% of r. Taken together in Equation 7 these angles result in $\sigma_c^{max}/p=6.36$ on the contact extensions. Using Equation 3 with this $\Phi$, the sharp peak stress distribution attending this maximum value is illustrated for x>0 in FIG. 5. The same peak stress distribution is present for x<0.

Figure 3:
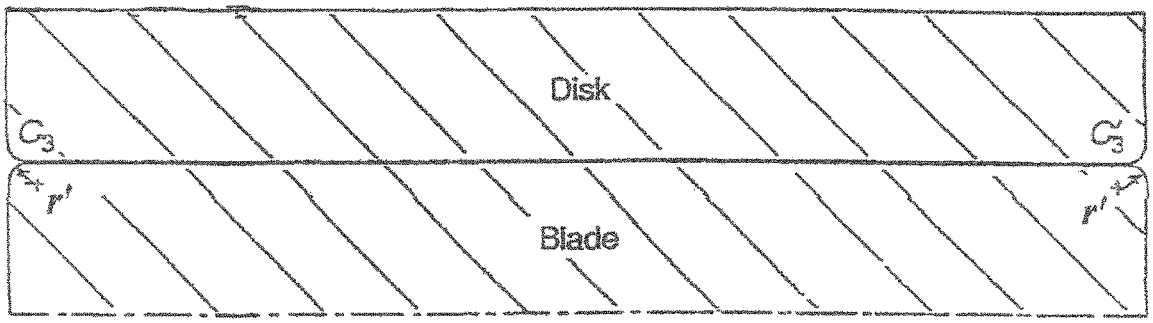
Fig.3 Prior Art
FIG. 3 is a section taken along lines III-III of FIG. 1, which is an out-of-plane section.
Figure 2:
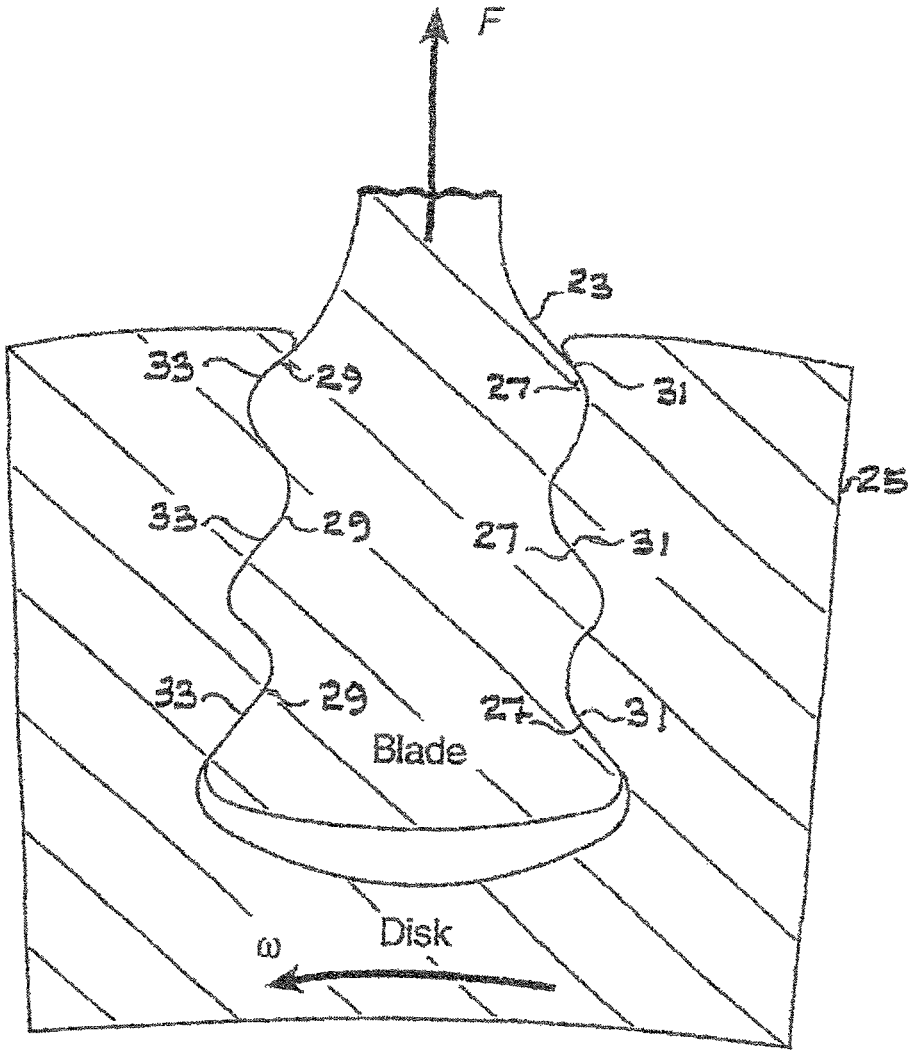
Fig.2 Prior Art
FIG. 2 is an elevational view of a prior art central in-plane section through a firtree attachment of a base of a turbine blade and a portion of a disk of a gas turbine engine.

For the out-of-plane direction of FIG. 3, solving Equations 5 and 6 for r'/L', where L' is the length of the contact flat in this direction, yields the extent of the contact region and the location of the maximum contact pressures in this plane. Thereafter Equations 3 and 7 furnish the contact pressure distribution and its maximum value. At maximum rpm for dovetail attachments like the one underlying FIG. 5, the contact pressure distribution is similar to that shown in FIG. 5, and, as in this figure, features a sharp peak value occurring just inside the edge of contact.

Returning to the in-plane configuration of FIG. 1, when the moment M acts in the direction shown in FIG. 4, maximum contact pressures are increased when x>0, decreased when x<0. Denoting the so altered values by $\sigma_c^M$, Sinclair, Paper No. GT 2015-42991, *ASME Turbo Expo*, Montréal, 2015, has $$\sigma_c^M = \sigma_c^{max}\left[1+\frac{2\sigma}{3p}\mathrm{sgn}(x)\right]^{2/3}, \quad \text{(Equation 8)}$$

where sgn is the signum function. For the specific dovetail attachment generating FIG. 5, Equation 8 results in modifications to peak contact stresses of ±24%. For these local peak values with M, local stress distributions parallel those without M (i.e., as in FIG. 5).

Figure 6:
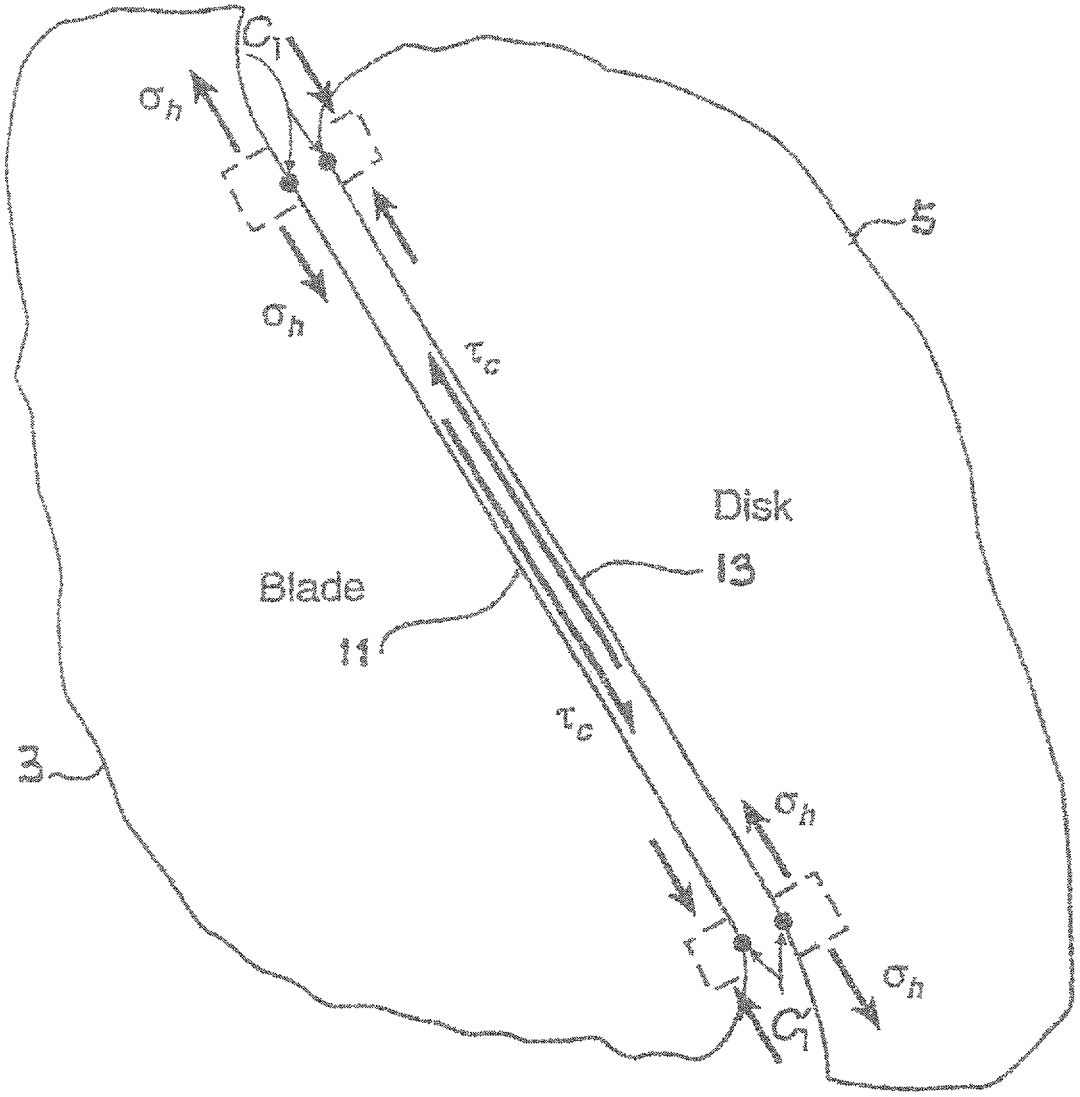
Fig. 6 Prior Art
FIG. 6 is an elevational view of a separated portion of the arrangement shown in FIG. 1 showing a representation of contact shear stresses and attendant hoop stresses.

With the sliding between the blade base and the disk that occurs during loading up to maximum rpm, a frictional contact shear stress, $\tau_c$, is introduced (FIG. 4). This shear stress acts on $C_1C_1$' of FIG. 1 so as to oppose relative motion between the blade base and the disk as shown in FIG. 6. Absent M and bending stresses present, this stress is simply given by Coulomb's law. That is, $$\tau_c=f\sigma_c, \quad \text{(Equation 9)}$$

wherein $\sigma_c$ continues to be as in Equation 3 for the in-plane specifics, r and L. The presence of friction can be shown to have no effect on $\sigma_c$ of Equation 3 provided, as is usual in practice, the disk and the blade are made of the same material. With M and bending stresses present, $\tau_c$ can be expected to be modified in the same way as $\sigma_c$ is modified.

In addition to the contact pressure, $\sigma_c$, and shear stress, $\tau_c$, a normal hoop stress, $\sigma_h$, is induced by contact between the blade base and the disk. This hoop stress acts on a surface that is perpendicular to the contact surface (FIG. 4). Absent friction and M, this stress simply mirrors the contact pressure. That is $$\sigma_h = -\sigma_c \qquad \text{(Equation 10)}$$

throughout the contact region with $\sigma_c$ remaining as in Equation 3, provided r and L are used for in-plane (FIG. 1) stresses and r' and L' for out-of-plane (FIG. 3) stresses.

When friction is present, $\tau_c$ induces additional in-plane hoop stresses, but has no effect on out-of-plane hoop stresses. These additional hoop stresses are tensile at the edge of contact in the disk at $C_1$' (FIG. 1) and in the blade at $C_1$: conversely, they are compressive at the edge of contact in the blade at $C_1$' and in the disk at $C_1$. This hoop stress action is indicated in FIG. 6. Within the in-plane contact region, the actual hoop stress distribution is given in Sinclair, *ASME journal of Applied Mechanics*, Vol. 84, pp. 121001-8, 2017, and, for the disk, is $$\sigma_h = -\sigma_c + \frac{ELf}{4(1-\nu^2)r}\left(\frac{2x}{L} - \mathrm{sgn}(x)\right)H\left(\frac{2|x|}{L} - 1\right), \qquad \text{(Equation 11)}$$

for $|x| \le L_c/2$, wherein H is the Heaviside step function. Changing the sign in Equation 11 furnishes the hoop stress distribution within the in-plane contact region for the blade base. These two hoop stress distributions have a maximum tensile stress, $\sigma_h^{max}$, with the common magnitude of $$\sigma_h^{max} = \frac{ELf}{4(1-\nu^2)r}(\sec\Phi - 1) \qquad \text{(Equation 12)}$$

at $x=L_c/2$ for the disk, $x=-L_c/2$ for the blade base. Near these peak tensile stresses at $x=+x^-$ and $x=-x^-$ for the disk and blade respectively, the hoop stress distributions feature local peak compressive stresses, $\sigma_h^{min}$. The locations of these minima can be determined by solving $$2\Phi\cot\phi^- + 2\pi f = \ln\left(\frac{\sin(\Phi+\phi^-)}{\sin(\Phi-\phi^-)}\right). \qquad \text{(Equation 13)}$$

for $\phi^-$, hence $x^-$ because $\cos\phi^- = 2x^-/L_c$. The corresponding minimum hoop stress is then given by $$\sigma_h^{min} = \frac{EL}{8\pi(1-\nu^2)r}\left[2\Phi\sec\Phi\,csc\phi^- + 2\pi f + \ln\left(\frac{\sin\Phi - \sin\phi^-}{\sin\Phi + \sin\phi^-}\right)\right]. \qquad \text{(Equation 14)}$$

Figure 7:
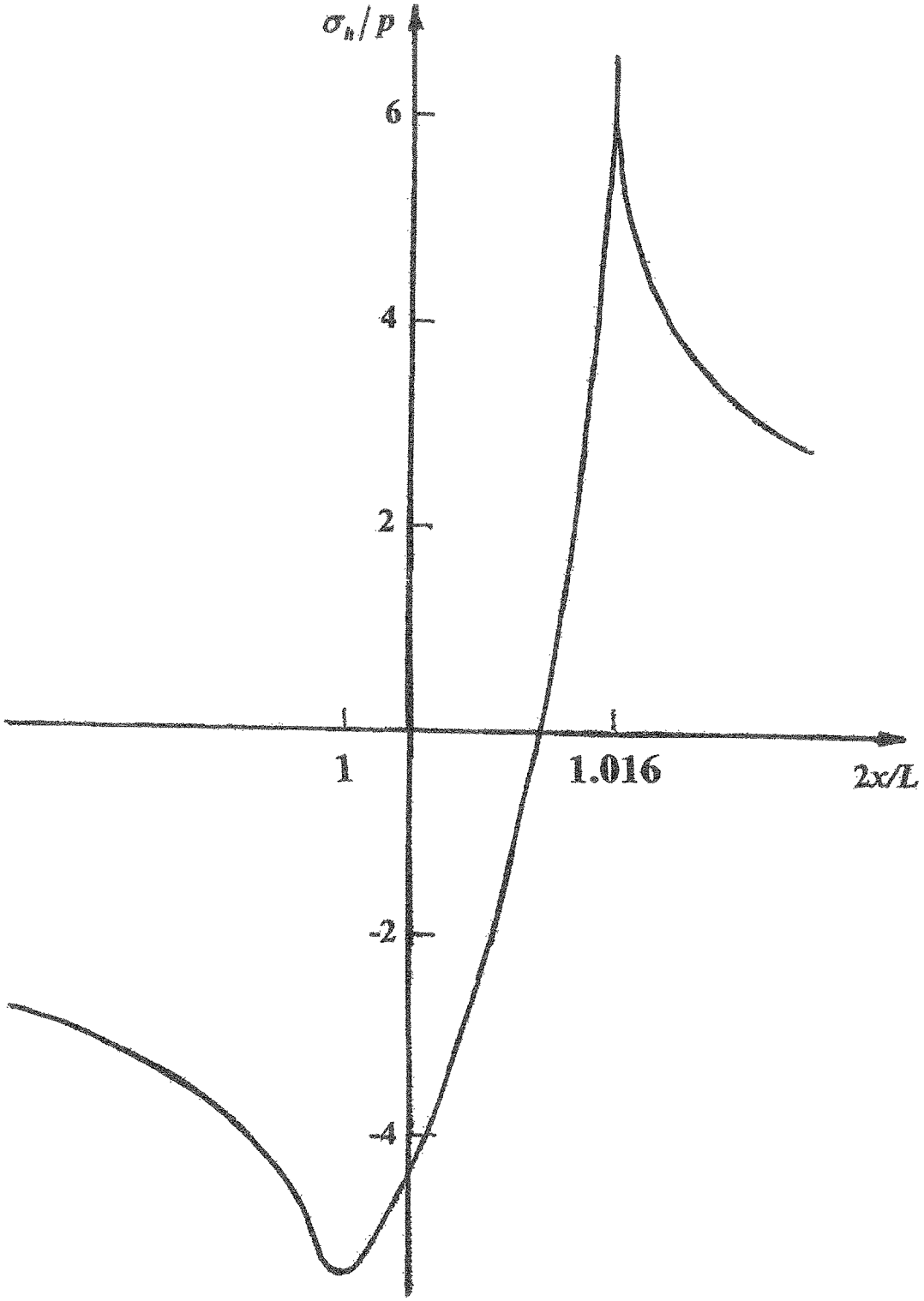
Fig. 7 Prior Art
FIG. 7 is a graphic representation of the contact hoop stress near the edge of contact.

A demonstration of the application of these equations for $\sigma_h$ for a dovetail attachment follows from taking the same specifications as earlier, namely $r/L=7/52$ and $p(1-\nu^2)/E=1.805\times10^{-3}$ at maximum rpm. For these specifications, $\Phi$ continues to be 10.2252 deg. Taking $f=0.4$, a maximum value of the friction coefficient encountered in blade attachments in gas turbines, Equation 12 results in $\sigma_h^{max}/p=6.64$. Then solving Equation 18 gives $\phi^-=10.0126$ deg, and Equation 14 results in $\sigma_h^{min}/p=-5.39$. These two local peak hoop stresses are shown in FIG. 7 for x near $L_c/2$ in the disk. The same hoop stress distributions occur for x near $-L_c/2$ in the blade base. These distributions are absent M. When M acts as in FIG. 4, the peak values are increased in the disk and reduced in the blade base in the same way as in Equation 8.

The foregoing edge-of-contact stresses are for loading up to maximum rpm with the slipping between the blade base and the disk that has to occur with initial increasing rpm. With decreasing rpm, the reverse interaction between the two occurs with the disk pinching the blade. Such pinching quickly eliminates tensile hoop stresses, and can even render them compressive. For example, for a dovetail attachment with the same specifications as described here, Sinclair et al., *ASME Journal of Engineering for Gas Turbines and Power*, Vol. 124, pp. 325-331, 2002, has a reversal of $\sigma_h/p$ from 8.0 to −5.4 with just a 10% drop off in operating rpm (these results include some increases due to M). While the specifics given here are for dovetail attachments, the same basic physics also applies to firtree attachments. That is, the slipping that occurs with initial increasing rpm produces tensile hoop stresses that are eliminated because of pinching with modest reductions in rpm. Then subsequent increases in rpm can eventually again lead to slipping with tensile hoop stresses, that again can be eliminated with modest reductions in rpm. Such fluctuations in these hoop stresses are the harbinger of fatigue failures. The objective of the present invention, therefore, is to reduce the magnitude of edge-of-contact stresses in blade attachments in general, and to reduce the tensile hoop stresses at the edges of contact in particular. In this way, fluctuations in these stresses with varying operating rpm are reduced, and fatigue failures made less likely.

Figure 8:
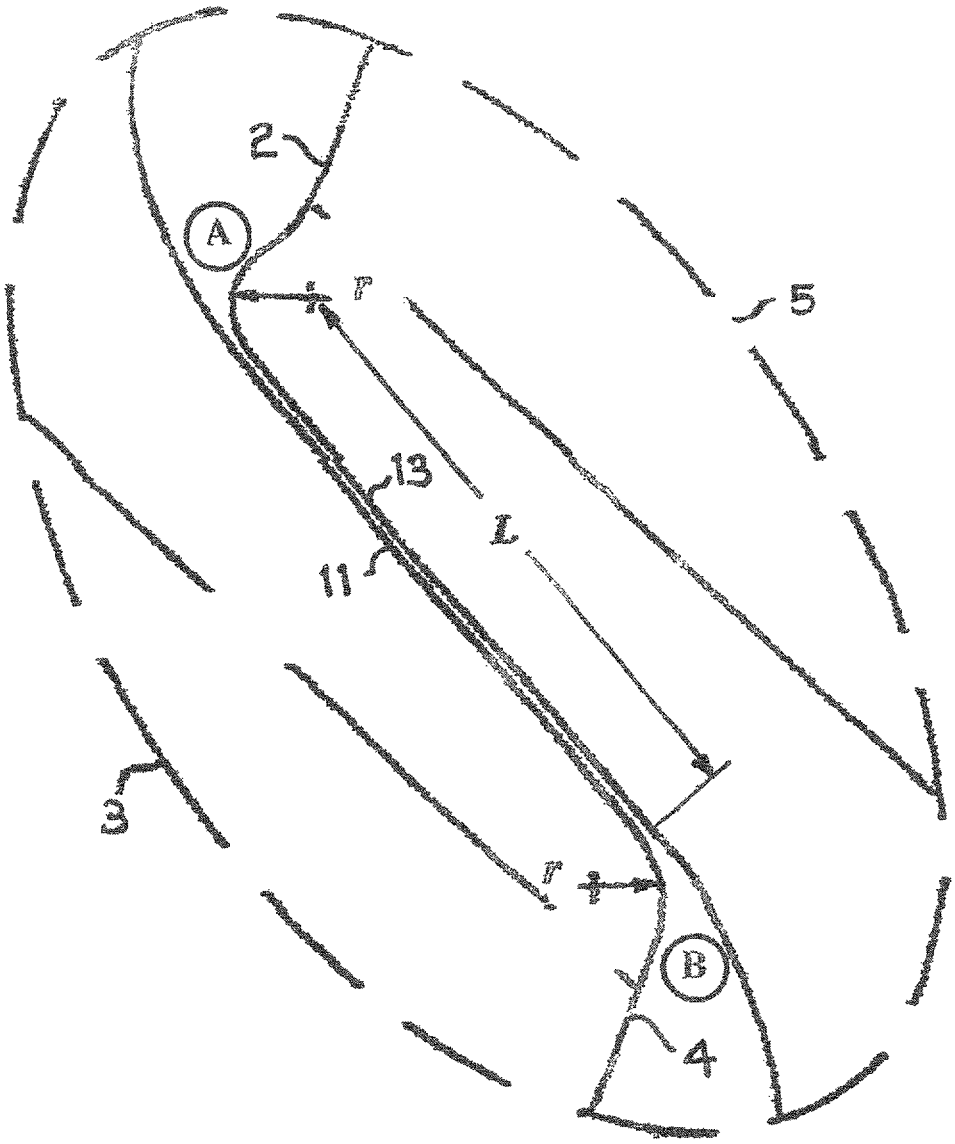
Fig. 8 Prior Art
FIG. 8 is an expanded elevational view of the close-up in FIG. 1 that labels areas near the leading edge, A, and the trailing edge, B.

The means put forward here to achieve reductions in edge-of-contact stresses is to increase edge radii by not having a single edge radius that blends with disks and blades in blade attachments. Here by "blend" is meant a single edge radius that produces an arc that, at its ends, is tangential to the straight boundary of the contact flat and the outer boundary of the disk or blade. Such blended edge radii are illustrated in the expanded close-up of FIG. 1 shown in FIG. 8. In FIG. 8, the disk 5 has the flat of length L in the contact surface smoothly blend with the arc generated by the upper edge radius r near A. This arc then also blends smoothly with the leading edge 2. Likewise in FIG. 8, the blade base 3 has the flat portion of its contact surface 11 blend smoothly with the arc generated by the lower edge radius r near B, then this arc blends smoothly with the trailing edge 4. Instead, as illustrated in FIG. 9 for the portion of the disk near A in FIG. 8, we introduce a larger radius R>r, that, by itself does not blend smoothly with the leading edge 2.

Figure 9:
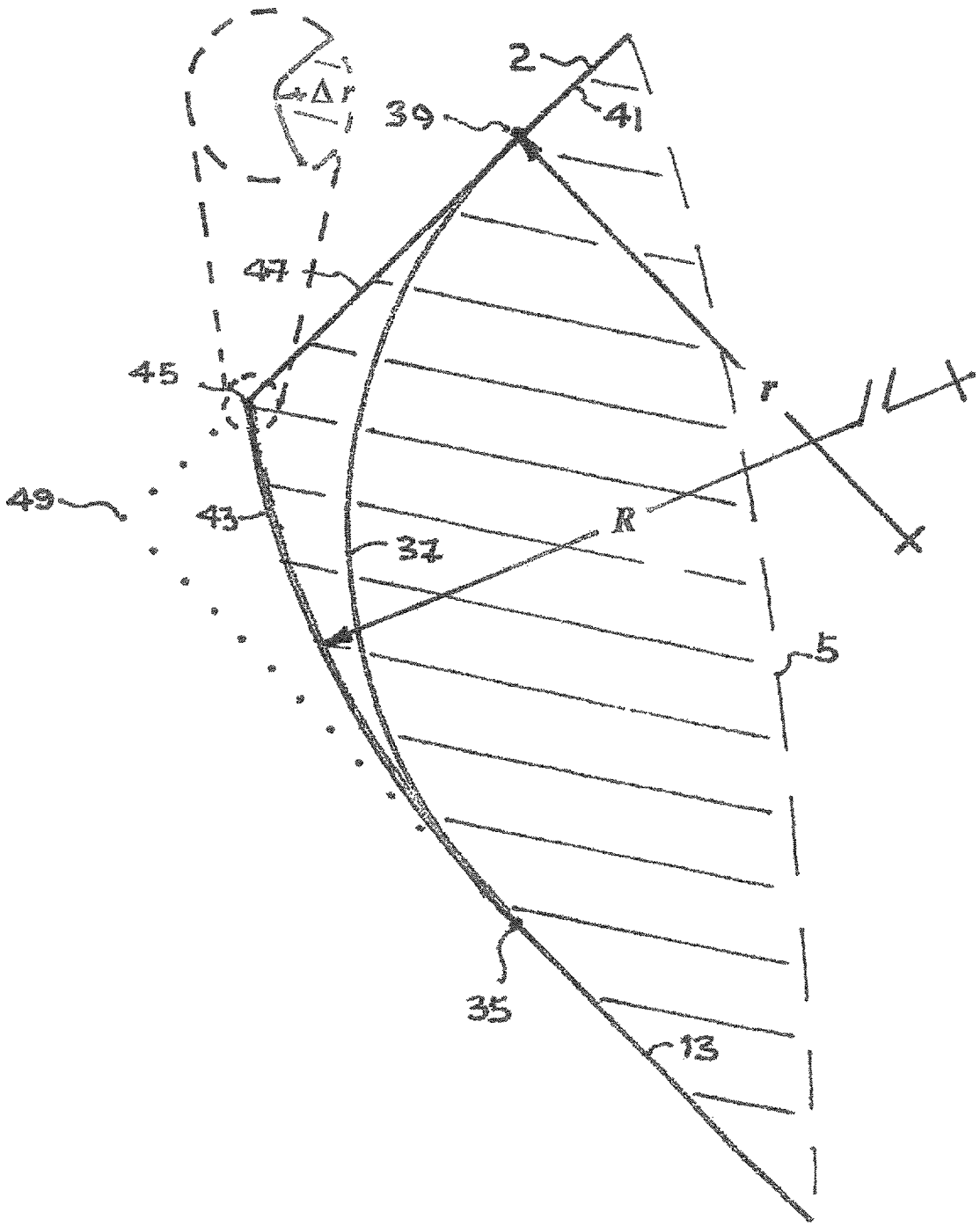
FIG. 9 is an elevational view of a portion of the disk in the arrangement shown in FIG. 8 near A showing the introduction of an unblended edge radius.

More precisely in FIG. 9, the existing arrangement has a radius r that smoothly blends the surface from the end of the contact flat of 13 at point 35 through point 37 until it smoothly connects with the outer surface 41 at point 39. The new surface has a radius R>r that continues to smoothly connect with the end of the contact flat of 13 at point 35. This new curved surface of radius R passes through point 43 then ends in a sharp corner 45 that is the intersection of the curved surface with the projection of the outer surface 41. This new projected straight boundary starts at point 39, passes through 47 and ends at 45. Alternatively the increased radius R can have a smaller radius Δr near 45 that does effect a smooth blending with the leading edge 2 as shown in the close-up of FIG. 9. With this arrangement the arc generated by R still does not blend smoothly by itself with the leading edge.

Figure 10:
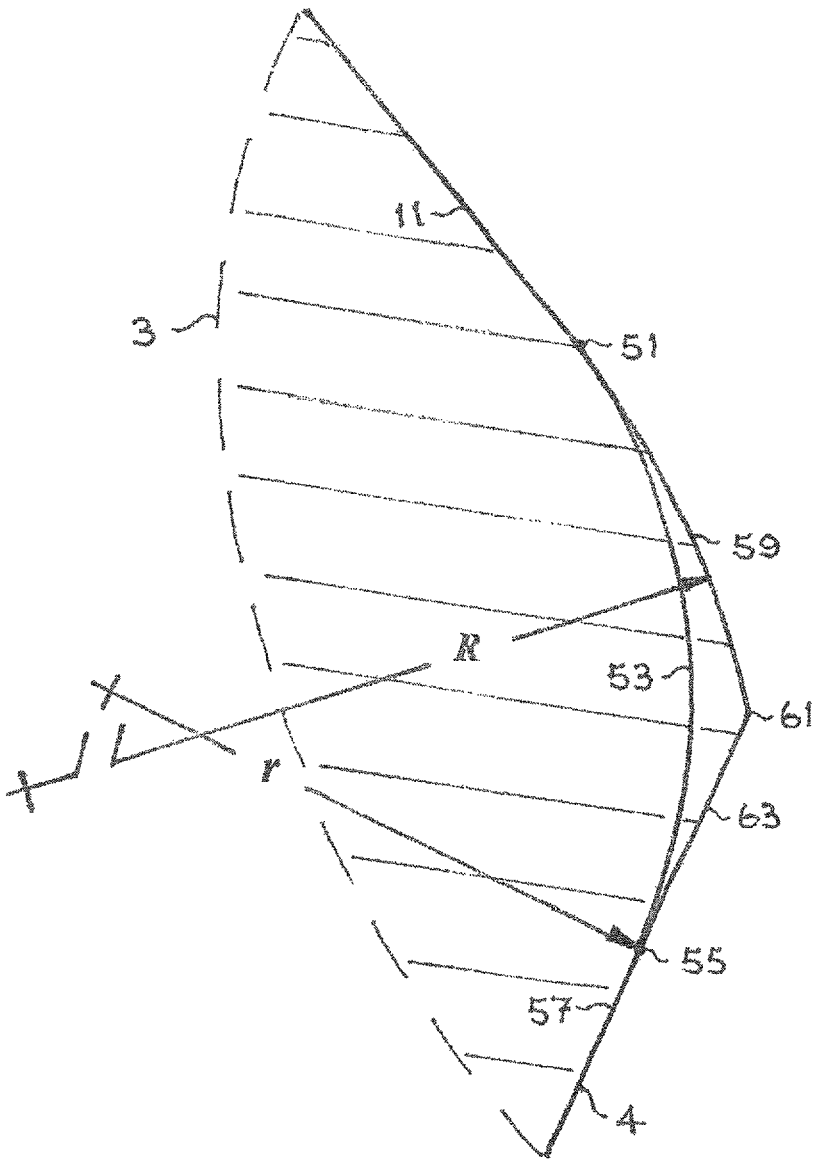
FIG. 10 is an elevational view of a portion of the blade base in the arrangement shown in FIG. 8 near B showing the introduction of an unblended edge radius.

Like arrangements can be employed to reduce edge-of-contact stresses for blade bases, as illustrated in FIG. 10 for the portion of the blade base near B in FIG, 8. In FIG. 10, the existing arrangement has a radius r that smoothly blends the surface from the end of the contact flat of 13 at point 51 through point 53 until it smoothly connects with the outer surface 57 at point 55. The new surface has a radius R>r that smoothly connects with the end of the contact flat of 11 at point 51. This new surface of radius R passes through point 59 then ends in a sharp corner 61 that is the intersection of the curved surface with the projection of the outer surface 57. As in FIG. 9, the sharp corner so produced can have a small radius. While FIG. 10 shows the same increased radius R as FIG. 9, this is not required. Similar increases in edge radii for the out-of-plane geometry (FIG. 3) can likewise be realized.

As a demonstration of the effectiveness of this approach, L is left unchanged in the specific dovetail attachment considered previously while r is increased from being such that r/L=7/52 so that it is replaced by R with R/L=1. For the same p at maximum rpm as earlier, Equation 5 now has Φ=19.496 deg. This corresponds to contact expanding onto the new edge radii by 3% of L compared to 0.8% with r. While this is thus a significantly larger contact expansion than with the blended radius r, it is still well short of expanding onto the sharp corner introduced with R without blending. It corresponds to utilizing but 23% of the length available from the edge of the contact flat, 35 in FIG. 9, to the sharp corner, 45 in FIG. 9. This increased contact region reduces contact pressures near the edge of contact. For Φ for r=R=L, Equation 6 now has $\hat{\phi}$=16.252 deg, and Equation 7 results in $$\sigma_c^{max}/p=3.24\text{cf.}6.36, \qquad \text{(Equation 15)}$$

Figure 11:
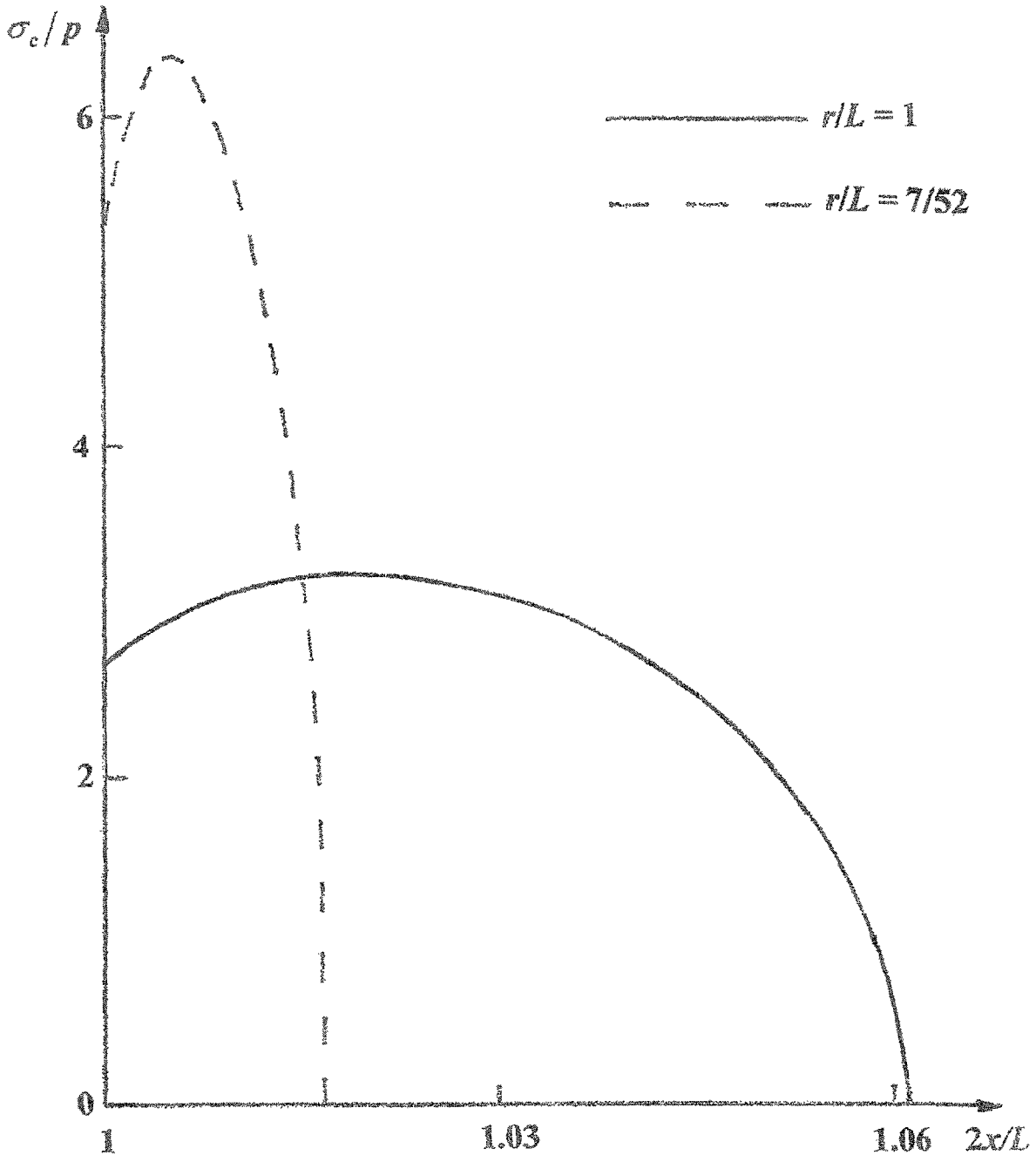
FIG. 11 is a graphic representation of the effects of an unblended edge radius on the contact pressure near the edge of contact.

In Equation 15, the number the unblended edge radius result is being compared with is the earlier result for the blended edge radius. Thus the unblended radius realizes a reduction in the peak contact pressure that approaches 50%. Using Equation 3, the local contact pressure distribution near the peak value of Equation 15 can be calculated for the unblended edge radius. In FIG. 11, a comparison is made between $\sigma_c$ with an unblended radius r=R=L (solid line) with the corresponding $\sigma_c$ with a blended radius, r/L=7/52 (dashed line), Similar reductions in $\sigma_c$ in the out-of-plane direction of FIG. 3 can be achieved by increasing r' with an unblended radius.

For the same unblended radius there is a like reduction in hoop stress values. For Φ for r=R=L, Equation 13 now has $\phi^{-}$=19.091 deg, and Equations 12 and 14 result in $$\sigma_c^{max}/p=3.37\text{cf.}6.64, \qquad \text{(Equation 16)}$$

$$\sigma_c^{min}/p=-2.75\text{cf.}-5.39. \qquad \text{(Equation 17)}$$

Figure 12:
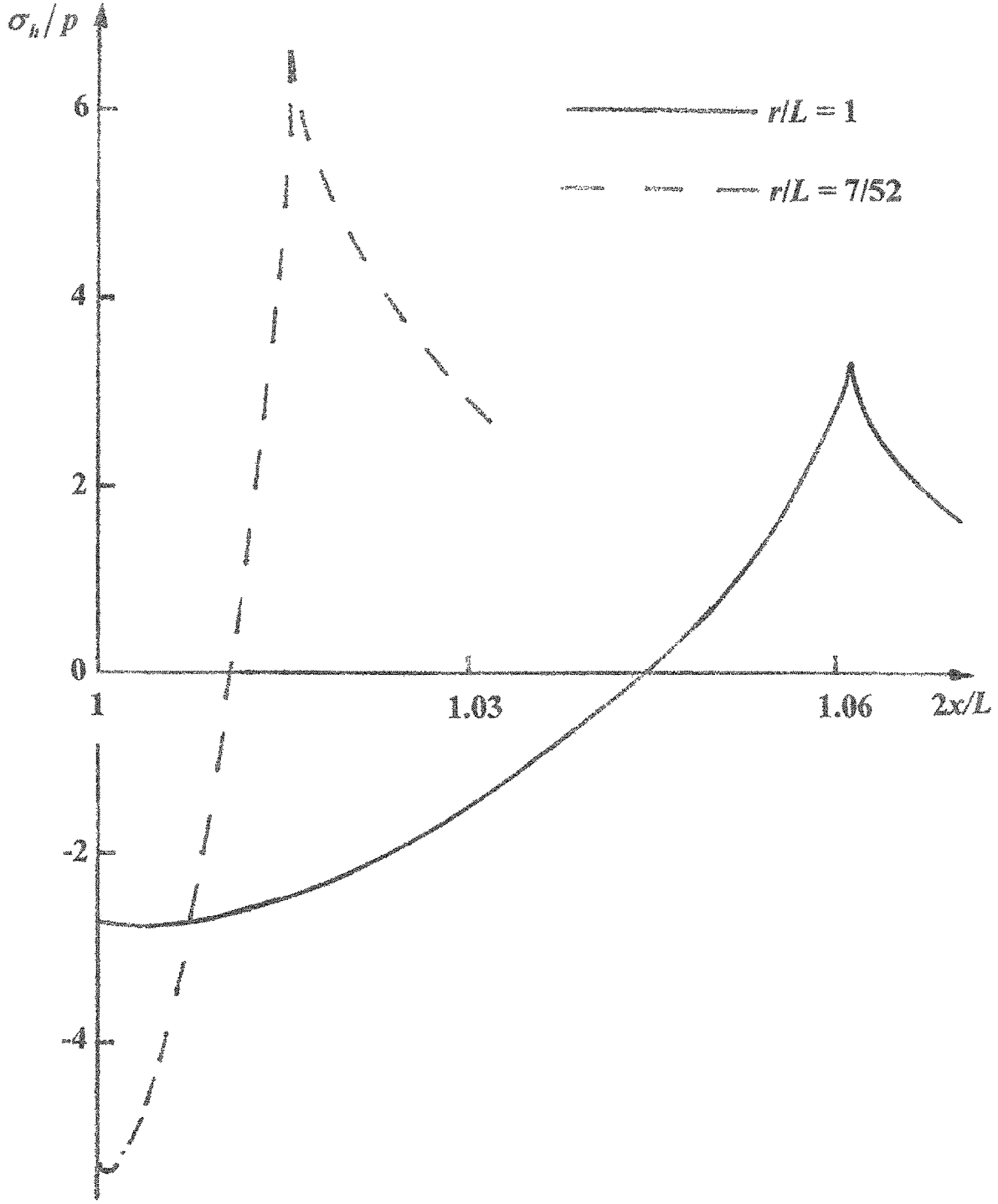
FIG. 12 is a graphic representation of the effects of an unblended edge radius on the contact hoop stress near the edge of contact.

Again with the unblended radius reductions in peak stress values that approach 50%. The local contact hoop stress distribution near the peak values of Equations 16 and 17 is shown in FIG. 12 for this unblended radius (solid line) and compared with the corresponding $\sigma_h$ with a blended radius (dashed line).

While it is not necessary to implement the present invention by continuing to take the same contact flat extent with the unblended radius as with the blended, this choice does facilitate an assessment of the effects of manufacturing unblended radii profiles. With unblended radii, there are smaller drops in contact surface profiles at outer edges than with blended radii. For example, in FIG. 9, 49 is the point located by the intersection of the projection of 13 and 41, and the drop with the unblended radius is from 49 to 45 whereas the drop with the blended radius is from 49 to 39. If the unblended radius profile is machined with precision broaching, this drop can be expected to be able to be maintained to within about half a thousandth of an inch (i.e., ±0.0005"). For the specific dovetail attachment considered here throughout but now with r=R=L, the effects of ±0.0005" on the drop with this unblended radius can be assessed using the given equations. If the drop is reduced by 0.0005", this assessment has that the expanded contact area is increased but still only takes up 28% of the available space and so is still well clear of the sharp edge present with the unblended radius. As a result of this increase in contact area, peak stresses $\sigma_c^{max}$, $\sigma_h^{max}$ and $\sigma_h^{min}$ are further reduced. These peak stresses are now 46% of their values for the blended radius. On the other hand, if the drop is increased by 0.0005", this assessment has that the expanded contact area is reduced and takes up 15% of the available space. As a result of this decrease in contact area, peak stresses are increased. Nonetheless these peak stresses are only 56% of their values for the blended radius.

The foregoing comparison of the effects of an unblended radius is for stresses absent bending effects. Bending effects due to M of FIG. 4 can still be expected to increase and decrease peak edge of contact stresses in line with Equation 8. Because these are the same modifications as present with the blended radius, the reductions in edge-of-contact stresses attended the unblended radius can be expected to remain essentially the same as already given (namely in the range of 44-54%). When M acts in the direction given in FIG. 4, there is an increase in the contact extent near $C_1$' of FIG. 1. For the specific dovetail attachment considered here with an unblended edge radius r=R=L and the same value of M as invoked earlier, even when this increase acts in concert with the increase that can attend machining, the contact expansion is less than 35% of the available space, thus well away from the sharp corner introduced with the unblended radius.

The previous demonstration is not altered if the sharp corner introduced by the unblended radius is blunted to a degree with a small local radius. This local radius has to be of a sufficiently small extent so that the contact expansion does not expand on to it.

The previous demonstration of the effects of introducing an unblended radius shows that significant reductions can result in edge-of-contact stresses in general, and critical peak hoop stresses in particular. Moreover, these reductions persist within a reasonable expectation of machining tolerances. With suitable care in implementation, this demonstration can be expected to be matched, or even exceeded, in terms of the reliable reductions in edge-of-contact stresses achieved with unblended radii both for dovetail and firtree attachments.

Having described the presently preferred embodiments of my invention, it is to be understood that it may otherwise be embodied within the scope of the appended claims.

The invention claimed is:

1. A blade for a gas turbine for attachment to a rotor disk comprising:

a) an airfoil;

b) a base to which the airfoil is attached, wherein the base is adapted to be received within a slot defined in the disk;

c) wherein the base has a contacting surface for contacting a corresponding surface of the disk, wherein the contacting surface comprises:

i) a flat surface, and ii) a transition surface having a first end and a second end, wherein the transition surface is made up of a radiused segment having a radius of curvature R at said first end blended and merged to the flat surface and at said second end intersecting with a side of the base to form a discontinuous intersection with the side of the base, wherein said discontinuous intersection comprises a fillet having a radius of curvature delta r that is at least an order of magnitude smaller than the radius of curvature R that terminates the radius of curvature R and is configured not to contact said surface of the disk when said blade is attached to said disk.

2. The blade according to claim 1, wherein the blade has an in-plane cross section contained within an in-plane plane extending radially through the blade attached to the disk and an out-of-plane cross section contained within an out-of-plane plane extending orthogonal to and through the flat surface of the base, wherein the in-plane plane is transverse to the out-of-plane plane, and wherein the in-plane cross section is a face profile of the blade.

3. The blade according to claim 2, wherein a cross section of the transition surface is contained within the in-plane plane and includes a face profile of the transition surface and the flat surface is contained within a flat surface plane that is transverse to the in-plane plane and the out-of-plane plane.

4. The blade according to claim 3, wherein a second cross section of a second out-of-plane transition surface is contained in the out-of-plane plane and includes a second profile of the second out-of-plane transition surface.

5. The blade according to claim 2, wherein a cross section of an out-of-plane transition surface is contained within the out-of-plane plane, and includes a profile of the out-of-plane transition surface, wherein an out-of-plane flat surface is contained within a plane that is transverse to the in-plane plane and the out-of-plane plane.

6. The blade according to claim 1, wherein the radius of curvature R is at least two times greater than a radius of curvature r that would be required to blend and merge with the flat surface and the side of the base such that the discontinuous intersection is not formed.

7. The blade according to claim 1, wherein radius of curvature delta r is an order of magnitude smaller than the radius of curvature R.

8. The blade according to claim 1, wherein the blade has a plurality of contacting surfaces including the contacting surface.

9. The blade according to claim 1, wherein the base is a dovetail.

10. The blade according to claim 1, wherein the base is a firtree.

11. The blade according to claim 1, wherein the radius of curvature R is greater than a radius of curvature r necessary to construct the radiused segment such that the discontinuous intersection is not present.

12. The blade according to claim 11, wherein the blending of the curved surface with the radius of curvature R with the flat surface begins at the same location on the flat surface as would be necessary for the blending of the radiused segment with the radius of curvature r.

13. A rotor disk for a gas turbine for receiving a base of a turbine blade comprising:

a) a contacting surface within a slot to receive the base of the blade for contacting a corresponding contacting surface of the base of the blade, wherein the contacting surface within the slot comprises:

i) a flat surface, and ii) a transition surface comprising a first end and a second end, wherein said at least one transition surface is made up of a radiused segment having a radius of curvature R at said first end blended and merged to the flat surface and at said second end intersecting with a side of the disk to form a discontinuous intersection with the side of the disk, wherein said discontinuous intersection comprises a fillet having a radius of curvature delta r that is at least an order of magnitude smaller than the radius of curvature R that terminates the radius of curvature R and is configured not to contact said surface of the base of the blade when said base of said blade is received by said slot.

14. A gas turbine engine having a plurality of blades attached to a rotor disk, wherein each of the blades comprises:

a) an airfoil;

b) a base to which the airfoil is attached, wherein the base is adapted to be received within a respective slot defined in the disk;

wherein each respective slot and base have a respective slot contacting surface and a base contacting surface adapted to contact each other during rotation of the disk, wherein each base contacting surface comprises:

i) a flat surface, and ii) a transition surface comprising a first end and a second end, wherein said at least one transition surface is made up of a radiused segment having a radius of curvature R at said first end blended and merged to the flat surface and at said second end intersecting with a side of the base to form a discontinuous intersection with the side of the base, wherein said discontinuous intersection comprises a fillet having a radius of curvature delta r that is at least an order of magnitude smaller than the radius of curvature R that terminates the radius of curvature R and is configured not to contact said slot contacting surface when said base is received by said slot.

15. The gas turbine engine according to claim 14, wherein the base of each of the blades is a dovetail.

16. The gas turbine engine according to claim 14, wherein the base of each of the blades is a firtree.

17. A method for manufacturing a gas turbine rotor disk contacting surface and a base contacting surface of a turbine blade for securement against one another, wherein:

the turbine blade is comprised of an airfoil and a blade base to which the airfoil is attached, wherein the blade base has at least one base contacting surface including the base contacting surface, the blade base is adapted to be received against the rotor disk, wherein the rotor disk has at least one contacting surface including the rotor disk contacting surface, wherein each blade base contacting surface has a corresponding rotor disk contacting surface of the at least one rotor disk contacting surface and the respective blade base and rotor disk contacting surfaces are adapted to oppose and partially contact each other during rotation of the disk, wherein one of (1) the rotor disk contacting surface, and (2) the blade base contacting surface is comprised of a profile having: a flat surface and a transition surface, wherein the transition surface comprising a first end and a second end is made up of a radiused segment having a radius of curvature R at the first end blended and merged to the flat surface and at the second end intersecting with a side of the disk or a side of the blade base, respectively, to form a discontinuous intersection with the side of the disk or the side of the blade base, respectively, wherein said discontinuous intersection comprises a fillet having a radius of curvature delta r that is at least an order of magnitude smaller than the radius of curvature R that terminates the radius of curvature R and is configured not to contact the respective opposed contacting surface when said blade base is received against said rotor disk during rotation of the disk, wherein a stress analysis of the profile and the respective opposed contacting surface is utilized to adjust the transition surface to position the discontinuous intersection; the method comprises the step of:

a) machining the profile pursuant to the adjusted transition surface.

18. A blade for a gas turbine for attachment to a rotor disk comprising:

an airfoil attached to a base, wherein said base is adapted to be received within a slot defined in the disk and comprises a contacting surface for contacting a corresponding surface of the disk and a side surface, wherein each contacting surface includes: a flat surface and a curved surface with a radius of curvature R so that the curved surface blends with the flat surface and the curved surface with the radius of curvature R is terminated by a discontinuous intersection with the respective side surface, wherein said discontinuous intersection comprises a fillet having a radius of curvature delta r that is at least an order of magnitude smaller than the radius of curvature R, wherein said curved surface is configured not to contact said surface of the disk when said base is received by said slot and wherein the radius of curvature R is larger than a radius of curvature r that would be necessary to blend the curved surface and the respective side surface so that the discontinuous intersection is not present.

19. The blade according to claim 18, wherein the radius of curvature R is at least four times greater than the radius of curvature r.

* * * * *